US010918554B2

(12) United States Patent
Jacobs et al.

(10) Patent No.: US 10,918,554 B2
(45) Date of Patent: Feb. 16, 2021

(54) CREMATION URN AND METHOD OF MANUFACTURE

(71) Applicants: Carrie A. Jacobs, Buffalo, MN (US); Lavina C. Lau, Eagan, MN (US)

(72) Inventors: Carrie A. Jacobs, Buffalo, MN (US); Lavina C. Lau, Eagan, MN (US)

(73) Assignee: Terrybear, Inc., St. Paul, MN (US)

( * ) Notice: Subject to any disclaimer, the term of this patent is extended or adjusted under 35 U.S.C. 154(b) by 101 days.

(21) Appl. No.: 16/144,734

(22) Filed: Sep. 27, 2018

(65) Prior Publication Data

US 2020/0100975 A1 Apr. 2, 2020

(51) Int. Cl.
*A61G 17/08* (2006.01)

(52) U.S. Cl.
CPC ..... *A61G 17/08* (2013.01)

(58) Field of Classification Search
CPC ..... A61G 17/08; B44C 5/00; B22F 3/1055; B33Y 10/00
USPC ..... 27/1; 428/542.2, 34.1
See application file for complete search history.

(56) References Cited

U.S. PATENT DOCUMENTS

D515,267 S * 2/2006 Wozniak ..... D99/5
7,191,498 B2 * 3/2007 Fischer ..... A61G 17/08 27/1

FOREIGN PATENT DOCUMENTS

CN 101664357 A * 3/2010

* cited by examiner

*Primary Examiner* — William L Miller
(74) *Attorney, Agent, or Firm* — Merchant & Gould P.C.

(57) ABSTRACT

An urn includes a container body and a lid that covers an internal cavity of the container body. Filigree wires attached to exterior surfaces of the container body and lid define cells filled with layers of enamel. The filigree wires are twisted wires that have a beaded texture, and have exposed portions that extend beyond the layers of enamel.

10 Claims, 18 Drawing Sheets

CREMATION URN AND METHOD OF MANUFACTURE

BACKGROUND

Cremation is a funeral rite where the remains of a deceased loved one are turned into ashes. Often, the ashes are held in a decorative vessel such as an urn that can be displayed as a memorial for the deceased loved one. The manufacture of cremation urns can be labor intensive, time consuming, and expensive due to the many steps that are often required to create a finished decorative piece. Therefore, improvements are needed to reduce the labor and costs associated with the manufacture of cremation urns, while still producing decorative pieces of high artistic value.

SUMMARY

The present disclosure relates generally to an urn, and a method of manufacturing the urn. In one possible configuration and by non-limiting example, the urn is a cremation urn manufactured by a modified cloisonné technique.

In one aspect, the present disclosure relates to an urn comprising: a container body having an internal cavity; a lid configured to cover the internal cavity; a plurality of filigree wires attached to at least one of the container body and the lid, the filigree wires delimiting a plurality of cells; and layers of enamel arranged in the plurality of cells and covering at least portions of the container body and the lid, the layers of enamel leaving exposed portions of the plurality of filigree wires that extend beyond the layers of enamel. In some examples, two layers of enamel are arranged in the plurality of cells, and the plurality of filigree wires extend beyond the two layers of enamel.

In some examples, the urn includes a lid fastening assembly that fastens the lid onto an opening of the container body to close the opening. In some examples, the lid fastening assembly includes a first threaded surface around the opening of the container body, and a second threaded surface on the lid that can thread onto the first threaded surface for closing the internal cavity.

In some examples, the exposed portions of the filigree wires that extend beyond exterior surfaces of the container body and lid are finished with a finishing. In some examples, the finishing is electroplated nickel.

In some examples, the urn further comprises transition surfaces above, between, and below a narrowed neck portion, a rounded middle portion, and a pedestal portion, and the transition surfaces are electroplated with nickel.

In certain examples, the urn is configured to hold cremation remains.

In another aspect, the present disclosure relates to a method of manufacturing an urn comprising: forming a container body and a lid; attaching filigree wires to at least one of the container body and the lid, forming a plurality of cells on at least one of the container body and the lid; filling first and second layers of enamel into the plurality of cells, leaving the filigree wires extending beyond the first and second layers of enamel; and applying a finish to the filigree wires.

In some examples, attaching filigree wires to at least one of the container body and the lid includes: using an adhesive to attach the filigree wires, sprinkling a powdered solder over the filigree wires, and baking the filigree wires and powdered solder in a furnace. In some examples, forming the container body and the lid includes cutting flat metal sheets into appropriate sizes, and shaping the flat metal sheets.

In some examples, the method further comprises installing a lid fastening assembly for connecting the lid to the container body. In certain examples, installing the lid fastening assembly includes: assembling a first threaded surface around an opening of the container body; and assembling a second threaded surface onto the lid.

In some examples, applying the finish to the filigree wires includes electroplating the filigree wires with nickel. In certain examples, the filigree wires are not polished and are not flush with the first and second layers of enamel.

In some examples, the method further comprises using a dropper to apply the first and second layers of enamel into the plurality of cells. In some examples, the method further comprises applying first and second layers of enamel to an internal cavity of the container body and to an interior surface of the lid. In some examples, the method further comprises using a brush to apply the first and second layers of enamel to the internal cavity and to the interior surface of the lid.

A variety of additional aspects will be set forth in the description that follows. The aspects can relate to individual features and to combinations of features. It is to be understood that both the forgoing general description and the following detailed description are exemplary and explanatory only and are not restrictive of the broad inventive concepts upon which the examples disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
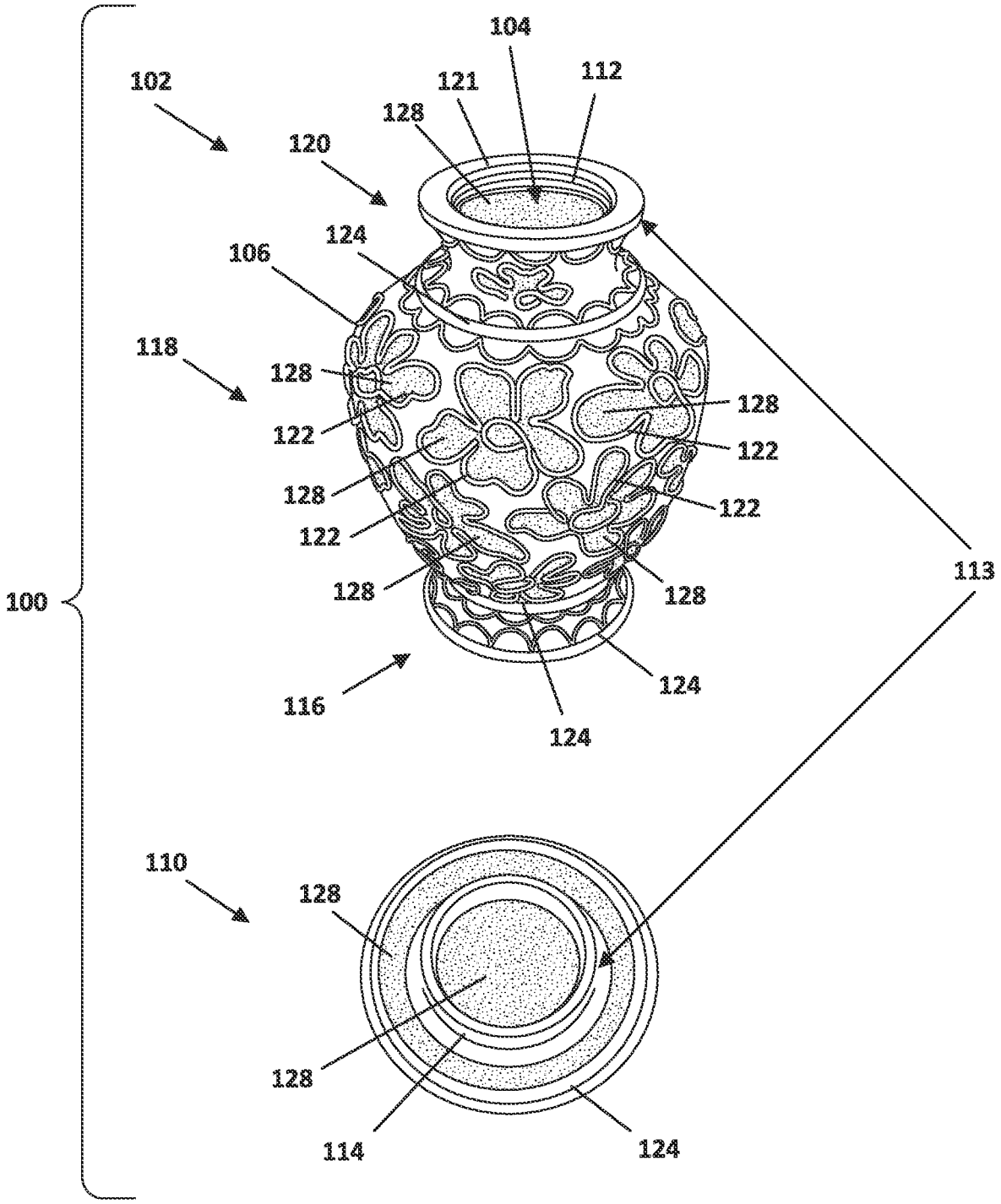
FIG. 1 is an isometric view of an urn.

Various embodiments of the present invention will be described in detail with reference to the drawings, wherein like reference numerals represent like parts and assemblies throughout the views. Reference to various embodiments does not limit the scope of the invention, which is limited only by the scope of the claims attached hereto. Any examples set forth in this specification are not intended to be limiting and merely set forth some of the many possible embodiments for the claimed invention.

FIG. 1 is an isometric view of an urn 100. As shown in FIG. 1, the urn 100 includes a container body 102 and a lid 110. The container body 102 has an internal cavity 104, an opening 121, and an exterior surface 106.

In certain examples, the container body 102 can have a shape that has a narrowed neck portion 120, a rounded middle portion 118, and a bottom pedestal portion 116. In other examples, the container body 102 can have a simplified shape that does not include the narrowed neck portion 120 or the bottom pedestal portion 116.

The pedestal portion 116 can have an enlarged diameter that supports the weight of the narrowed neck portion 120 and the rounded middle portion 118. The pedestal portion 116 can allow the urn 100 to stand upright when placed on a flat surface.

The rounded middle portion 118 can shape a majority of the volume of the internal cavity 104. The internal cavity 104 can be used to store a variety of different items. In certain examples, the internal cavity 104 can be used to store cremation ashes. For example, cremation ashes contained within a bag can be stored inside the internal cavity 104. In certain examples, the cremation ashes are human cremation ashes. In other examples, the cremation ashes are pet animal cremation ashes.

The narrowed neck portion 120 includes the opening 121 into the internal cavity 104. The narrowed neck portion 120 allows items to enter through the opening 121 for storage inside the internal cavity 104 shaped by the rounded middle portion 118.

A lid fastening assembly 113 is installed onto the urn 100 so that the lid 110 can cover and/or seal the internal cavity 104 of the container body 102. In some examples, the lid fastening assembly 113 can include a first threaded surface 112 around the opening 121 of the container body 102, and the lid fastening assembly 113 can further include a corresponding second threaded surface 114 on the lid 110 that can thread onto the first threaded surface 112 for securely closing the internal cavity 104.

Still referring to FIG. 1, the exterior surface 106 includes filigree wires 122 that are attached in a decorative pattern. In some examples, the filigree wires 122 are metal wires that are twisted about their longitudinal axis. In other examples, the filigree wires 122 are beaded metal wires. In some examples, the filigree wires 122 are made from copper or copper alloy, and are first attached to the exterior surface 106 of the container body 102, and then later coated with a coating. In some examples, the coating is an electroplated metal such as nickel, silver, gold etc. As shown in FIG. 1, the filigree wires 122 have a smooth, polished, and shiny finish.

Layers of colored enamel 128 fill the various cells delimited by the pattern of filigree wires 122 to provide an ornamental design on the exterior surface 106. For example, the filigree wires 122 can define a decorative pattern of flowers, and various colors of enamel 128 can fill the cells in the decorative pattern. Additionally, the internal cavity 104 can also be coated with enamel 128. The enamel 128 provides a colorful aesthetic appearance to the urn 100. In some examples, the enamel 128 provides a glossy finish. In other examples, the enamel 128 provides a matte finish.

As shown in FIG. 1, the urn 100 can include transition surfaces 124 above, between, and below the narrowed neck portion 120, the rounded middle portion 118, and the pedestal portion 116. The urn 100 can also include transition surfaces 124 on the lid 110. The transition surfaces 124 can be copper surfaces that have been polished and then coated with a coating. In some examples, the coating is an electroplated metal such as nickel, silver, gold etc. that generates a smooth, polished, and shiny finish.

Figure 2:
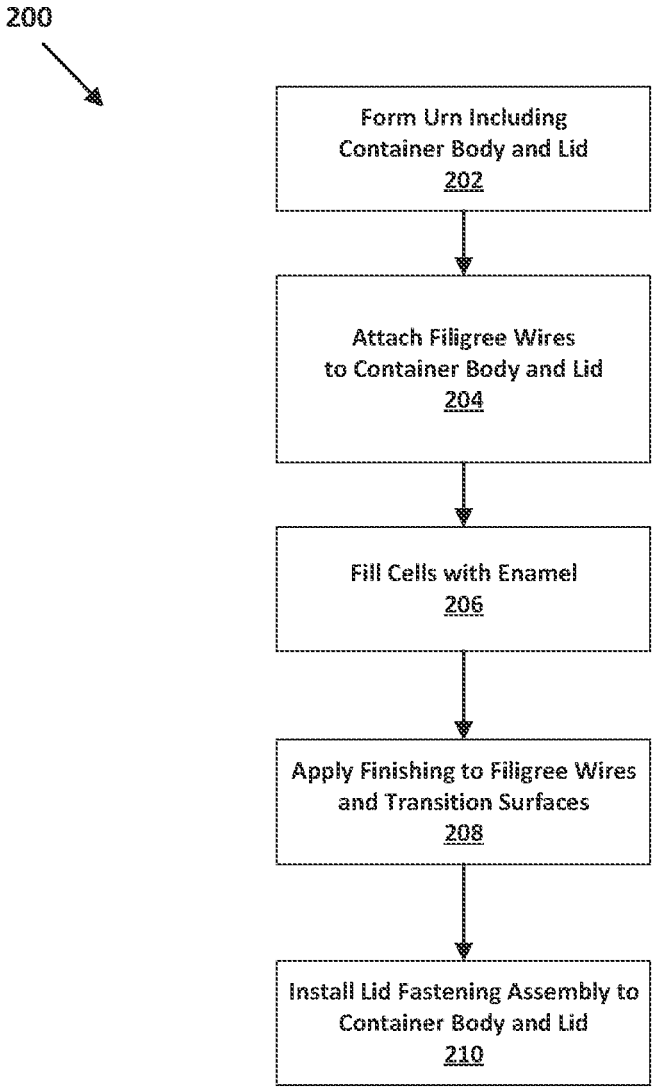
FIG. 2 illustrates a method of manufacture for the urn of FIG. 1.

FIG. 2 illustrates a method 200 for manufacturing the urn 100. The method 200 includes a step 202 of forming the urn 100 including the container body 102 and the lid 110. Step 202 will be described in more detail with reference to FIGS. 3-5.

As shown in FIG. 2, the method 200 next includes a step 204 of attaching the filigree wires 122 to the container body 102 and the lid 110. Step 204 of the method 200 will be described in more detail with reference to FIGS. 6-9.

Thereafter, the method 200 includes a step 206 of filling cells formed by a pattern of the filigree wires 122 with the enamel 128. Step 206 of the method 200 will be described in more detail with reference to FIGS. 10-12.

Next, the method 200 includes a step 208 of applying a finish to the filigree wires 122 and the transition surfaces 124 on the container body 102 and lid 110. Step 208 will be described in more detail with reference to FIGS. 13-15, 17, and 18.

Thereafter, the method 200 includes a step 210 of installing the lid fastening assembly 113 to the container body 102 and the lid 110. Step 210 of the method 200 will be described in more detail with reference to FIGS. 16-18.

Figure 3:
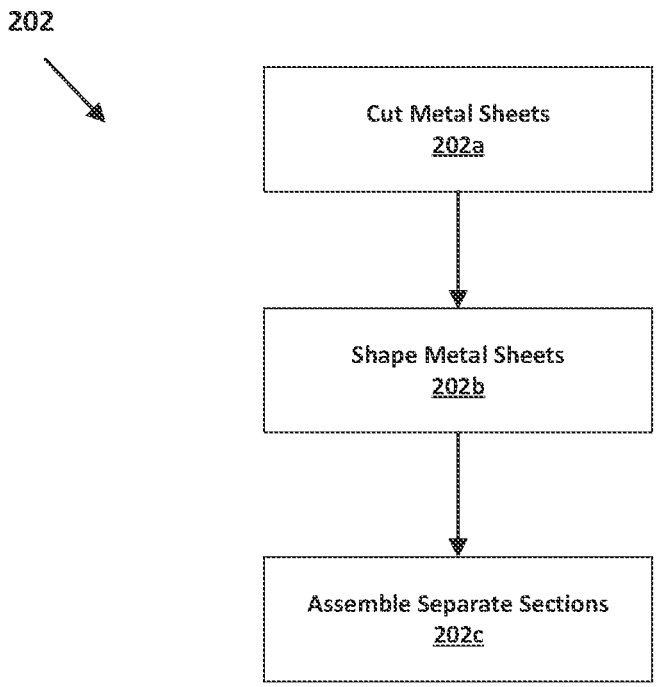
FIG. 3 illustrates a detailed portion of the method of FIG. 2.
Figure 4:
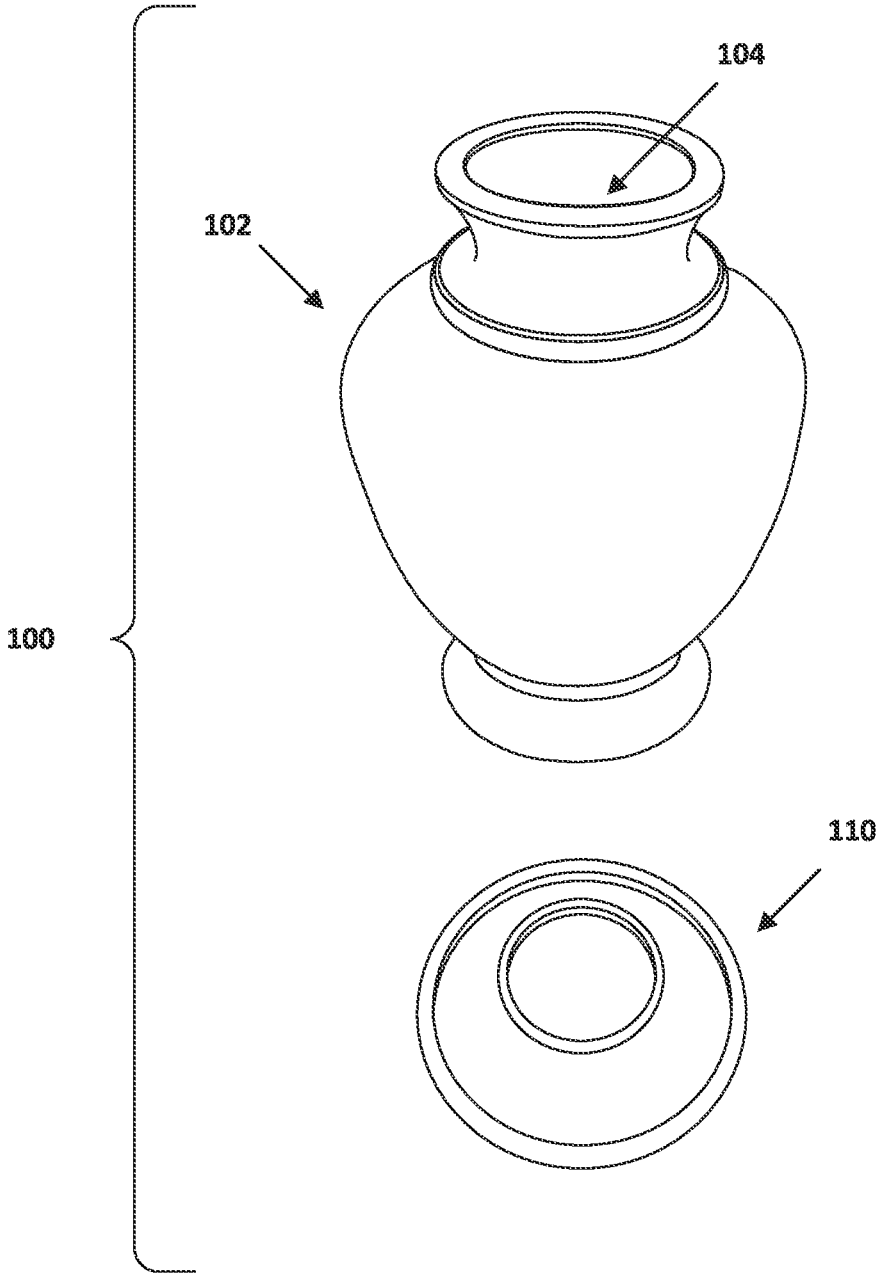
FIG. 4 is an isometric view of a container body and lid of the urn.
Figure 5:
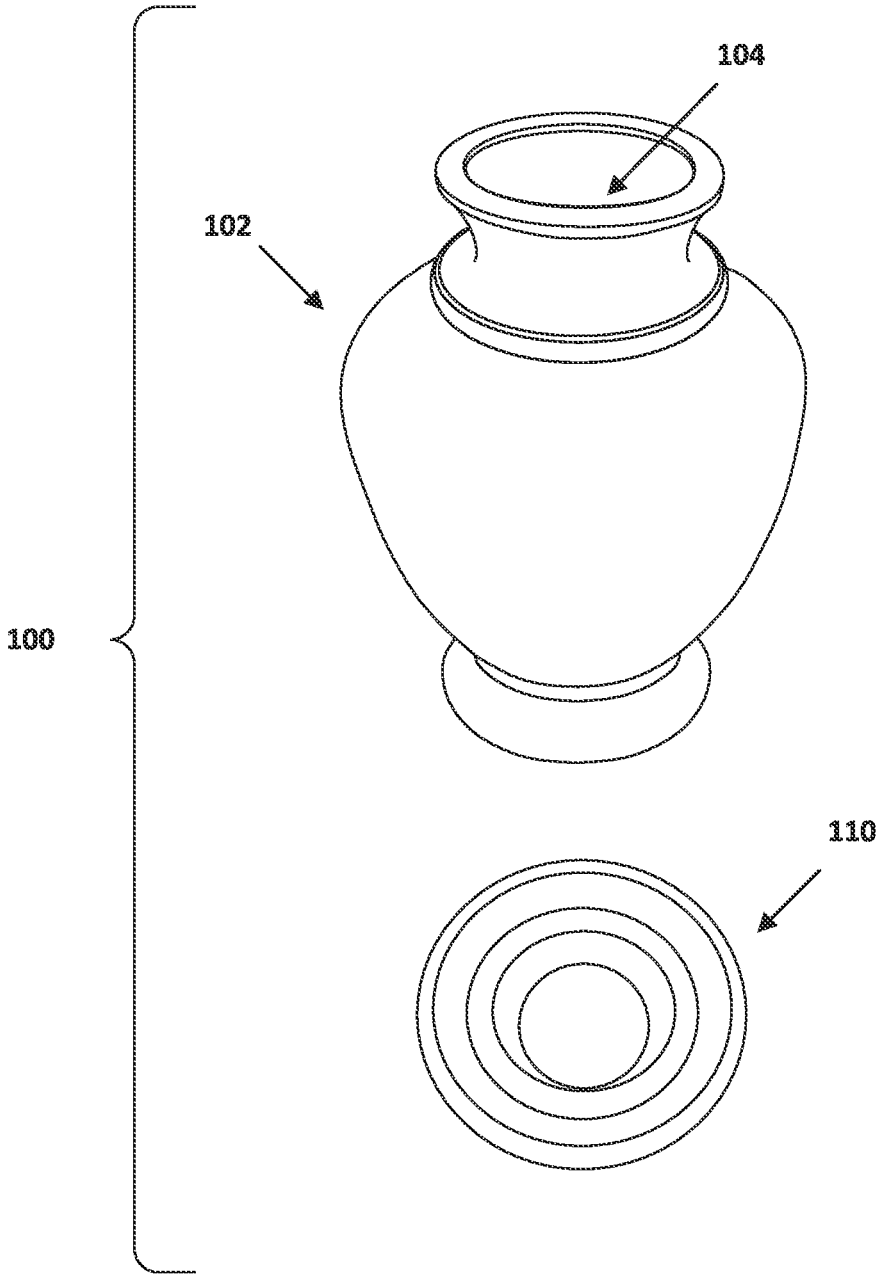
FIG. 5 is another isometric view of the container body and lid of the urn.

FIG. 3 illustrates step 202 in more detail including several sub-steps for forming the urn 100 including the container body 102 and the lid 110. FIGS. 4 and 5 show the urn 100 after completion of step 202. Referring now to FIGS. 3-5, the container body 102 and lid 110 can each be formed from metal sheets. In some examples, step 202 includes sub-step 202*a* of cutting flat metal sheets into appropriate sizes.

Thereafter, step 202 can further include sub-step 202*b* of shaping the flat metal sheets. In some examples, the flat metal sheets are shaped using a lathe. For example, a die can be mounted to a lathe, and a flat metal sheet can also be mounted to the lathe so that the flat metal sheet is spun on the lathe. While the flat metal sheet is spinning on the lathe, a bar can be used to pull the flat metal sheet over the die so that the flat metal sheet is shaped. In other examples, the flat metal sheets are shaped using a press. In preferred examples, the flat metal sheets are copper because copper is soft and easy to shape.

In some examples, the container body 102 has separate sections assembled together. In certain examples, the pedestal portion 116, rounded middle portion 118, and narrowed neck portion 120 are separate sections, each separately formed. Similarly, in some examples, the lid 110 includes sections that have been separately formed.

In the examples where the container body 102 and lid 110 have sections that are separately formed, step 202 of the method 200 can further include sub-step 202*c* of assembling the separate sections. In some examples, the separately formed sections are welded together. In other examples, the separately formed sections are soldered together.

As shown in FIGS. 4 and 5, after the completion of step 202, the container body 102 and lid 110 are each formed, and each have a plain exterior copper surface.

Figure 6:
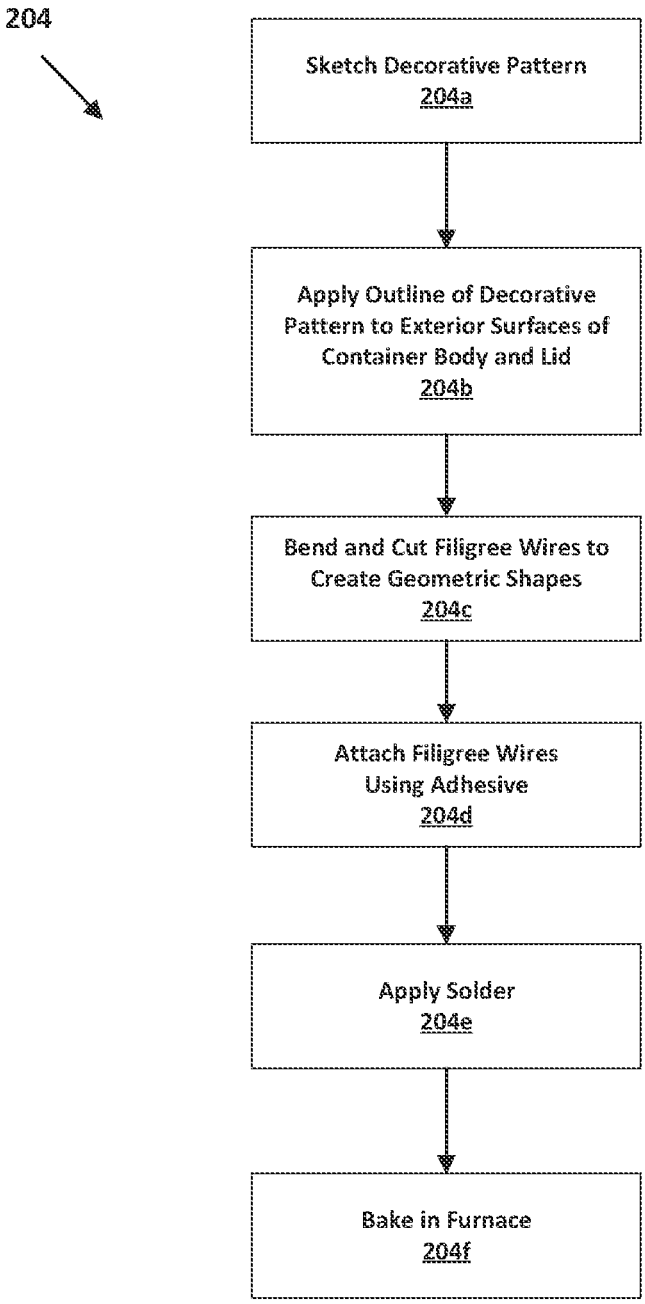
FIG. 6 illustrates another detailed portion of the method of FIG. 2.
Figure 7:
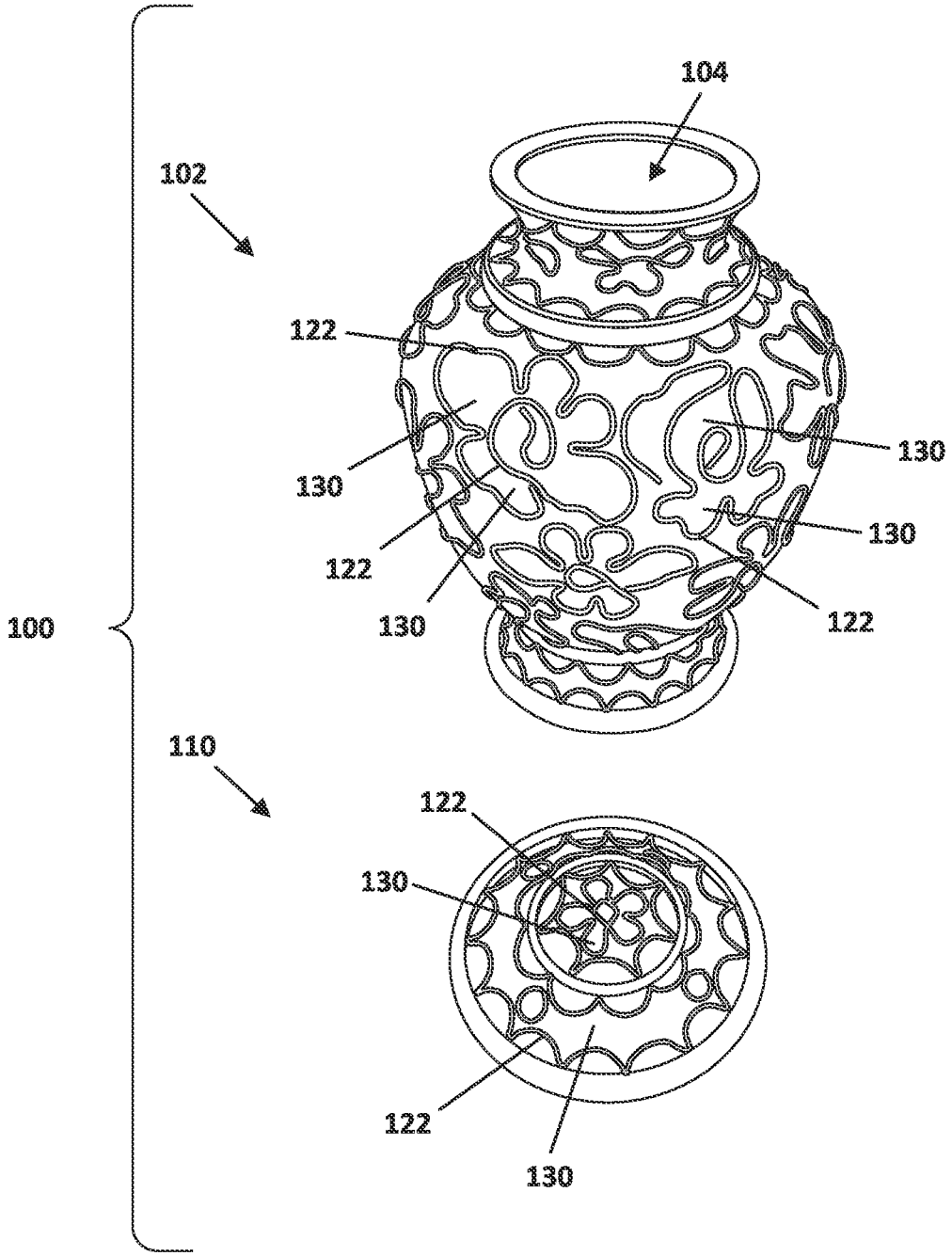
FIG. 7 is an isometric view of the urn after attaching filigree wires to exterior surfaces of the container body and lid.
Figure 8:
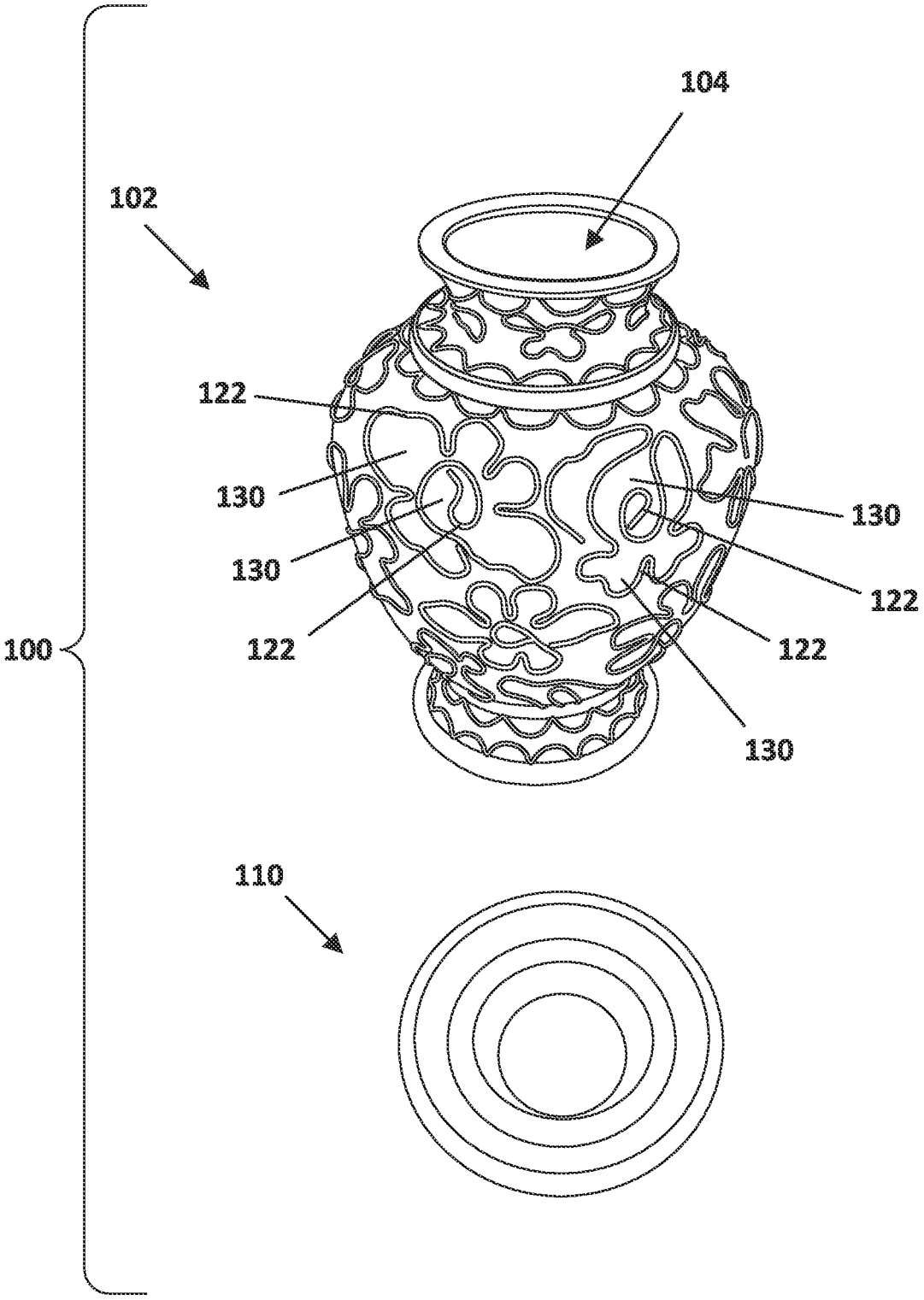
FIG. 8 is another isometric view of the urn after attaching the filigree wires to the exterior surfaces of the container body and lid.

FIG. 6 illustrates step 204 in more detail including several sub-steps for attaching the filigree wires 122 to the exterior surfaces of the container body 102 and lid 110. FIGS. 7 and 8 are isometric views of the urn 100 after the completion of step 204. As shown in FIGS. 7 and 8, the filigree wires 122 can be attached to follow a decorative pattern on the exterior surfaces of the container body 102 and lid 110.

In some examples, step 204 includes sub-step 204*a* of sketching the decorative pattern. In some examples, the decorative pattern is sketched using pencil and paper. In other examples, computers can be used to create the decorative pattern.

Next, step 204 can include sub-step 204*b* of applying an outline of the decorative pattern to the exterior surfaces of the container body 102 and lid 110 to help guide the attachment of the filigree wires 122. In some examples, the outline can be transferred to the exterior surfaces using carbon paper or similar techniques.

Thereafter, step 204 can include sub-step 204*c* of bending and cutting the filigree wires 122 to create decorative geometric shapes. In some examples, hand tools such as needle-nose pliers and dowels can be used to bend the filigree wires 122 into curves, circles, right angles, and other types of geometric shapes.

After bending and shaping the filigree wires 122, step 204 includes sub-step 204*d* of attaching the filigree wires 122 to the exterior surfaces of the container body 102 and lid 110 using an adhesive. In some examples, the adhesive is a glue.

Next, step 204 can include sub-step 204*e* of applying solder to the filigree wires 122 after the adhesive used to attach the filigree wires 122 to the exterior surfaces of the container body 102 and lid 110 has dried. In a preferred example, the solder is in powdered form and is sprinkled over the exterior surfaces of the urn 100 and the filigree wires 122 that have been glued thereto.

Thereafter, step 204 can include sub-step 204*f* of baking the container body 102 and lid 110 along with the attached filigree wires 122 and solder in a furnace. In some examples, the temperature of the furnace is raised to about 1000□ for about 2 minutes. Sub-step 204*f* strengthens the attachment of the filigree wires 122 to the exterior surfaces of the container body 102 and lid 110, and can also further strengthen the assembly of the sections of the container body 102 and lid 110 (see step 202).

The furnace used in sub-step 204*f* can be an electric or coal furnace. In a preferred example, an electric furnace is used because the temperature can more easily be controlled, and also because an electric furnace does not produce sulfur and other byproducts and contaminants (which is in contrast to coal furnaces which naturally produce sulfur and other byproducts due to the burning coal). Thus, an electric furnace can provide more consistent results than a coal furnace.

As shown in FIGS. 7 and 8, the filigree wires 122 form a decorative pattern having a plurality of empty cells 130 on the exterior surfaces of the container body 102 and lid 110 after the completion of step 204. As can be appreciated from the forgoing description, the bending, shaping, and application of the filigree wires 122 to the exterior surfaces of the container body 102 and lid 110 is a manual process. Thus, each urn 100 is inherently unique due to the variations that can occur during this manual process, and may accordingly involve some degree of artistic expression.

Figure 9A:
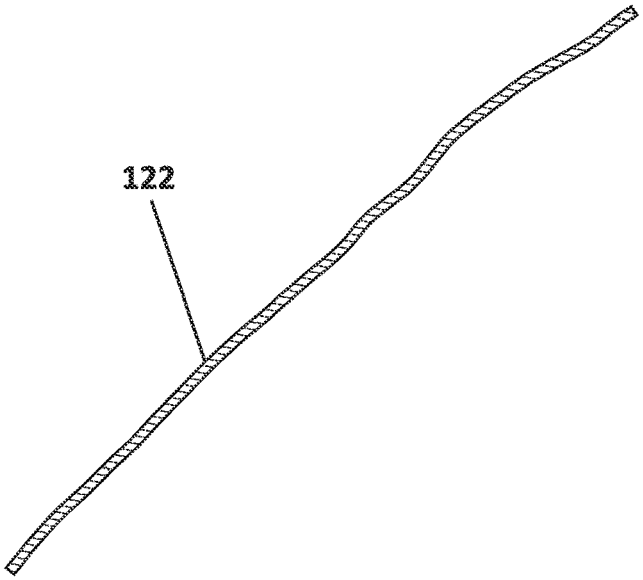
FIG. 9A is a detailed isometric view of a filigree wire.

FIG. 9A is a detailed isometric view of a filigree wire 122. In the example shown in FIG. 9A, the filigree wire 122 is a twisted wire that is twisted about its length. In other alternative examples, the filigree wires 122 can be beaded wires. The filigree wires 122 have a smooth, beaded texture that can provide several significant advantages (that will be described in more detail below).

Figure 9B:
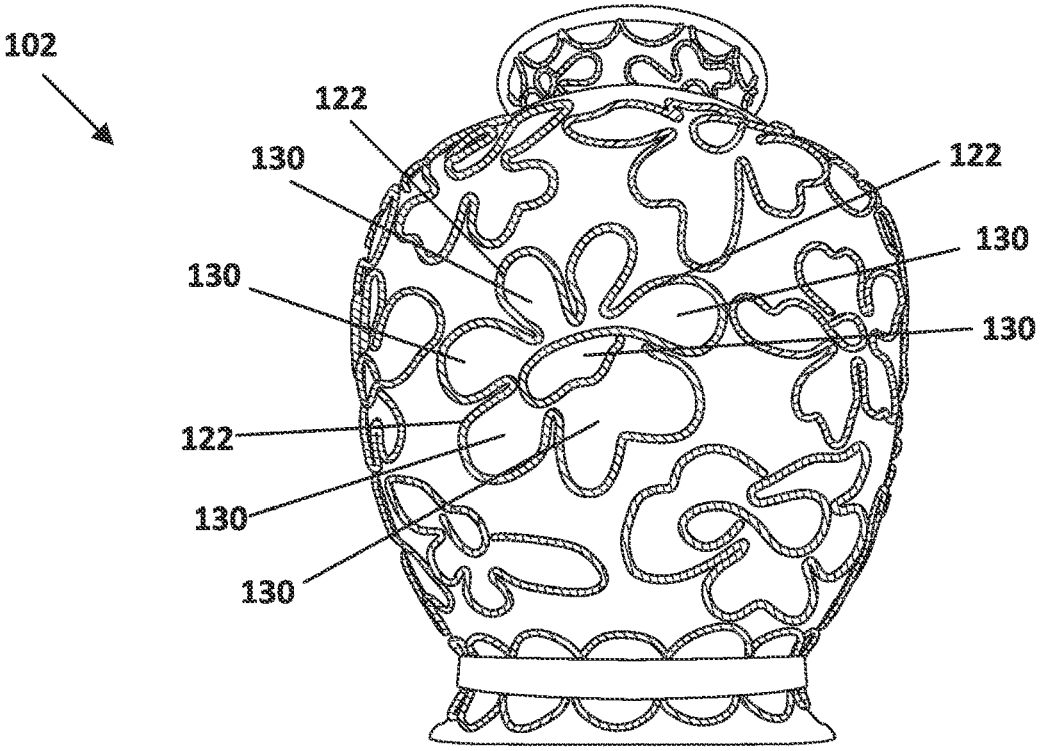
FIG. 9B is a detailed view of the filigree wires attached to the container body.

FIG. 9B is a detailed view of the filigree wires 122 attached to the container body 102. As shown in FIG. 9B, the filigree wires 122 form a plurality of cells 130 on the exterior surface of the container body 102. As will be described in more detail, the plurality of cells 130 can be filled with layers of enamel.

Figure 10:
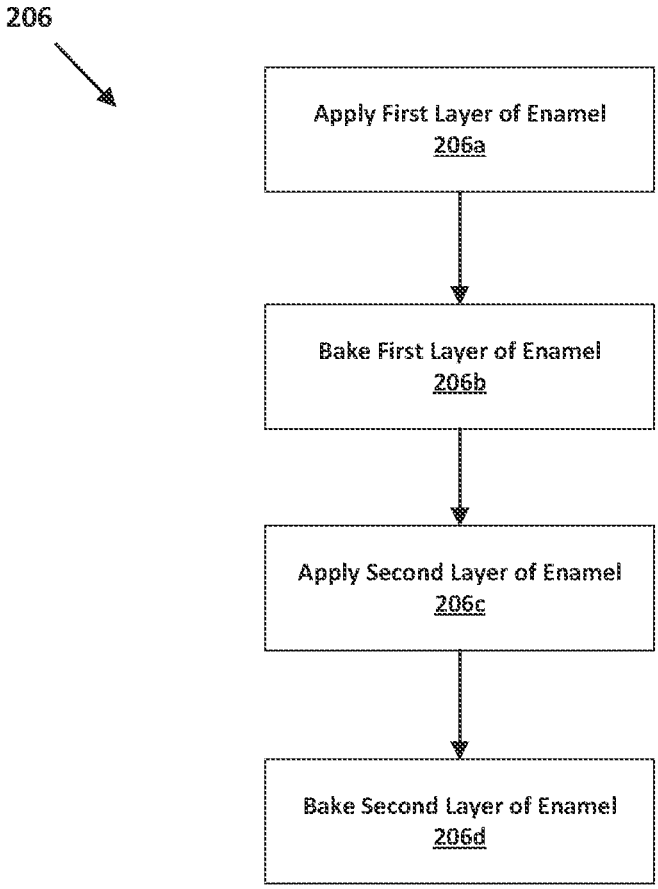
FIG. 10 illustrates another detailed portion of the method of FIG. 2.
Figure 11:
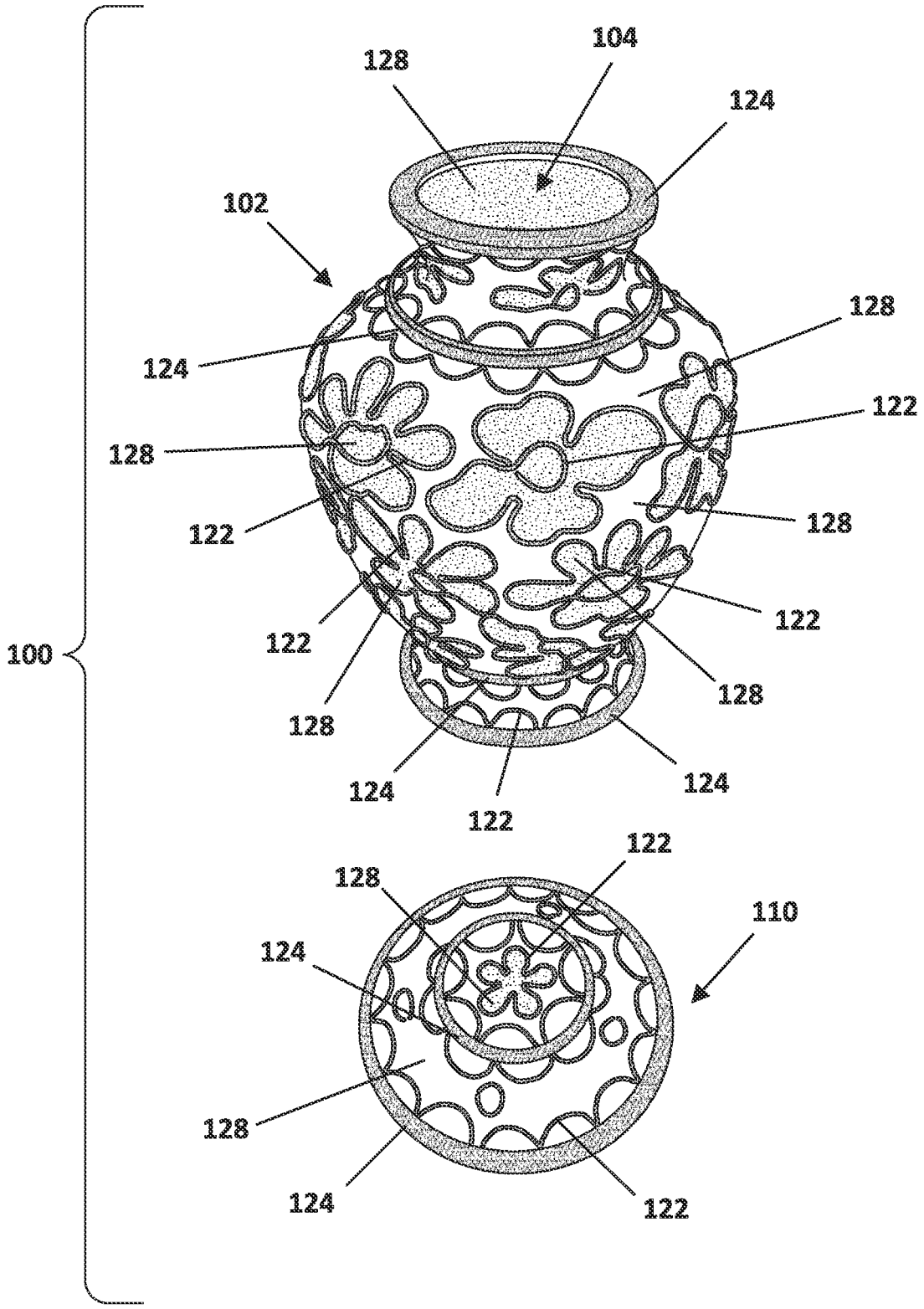
FIG. 11 is an isometric view of the urn after baking layers of enamel into cells formed by a pattern of filigree wires.
Figure 12:
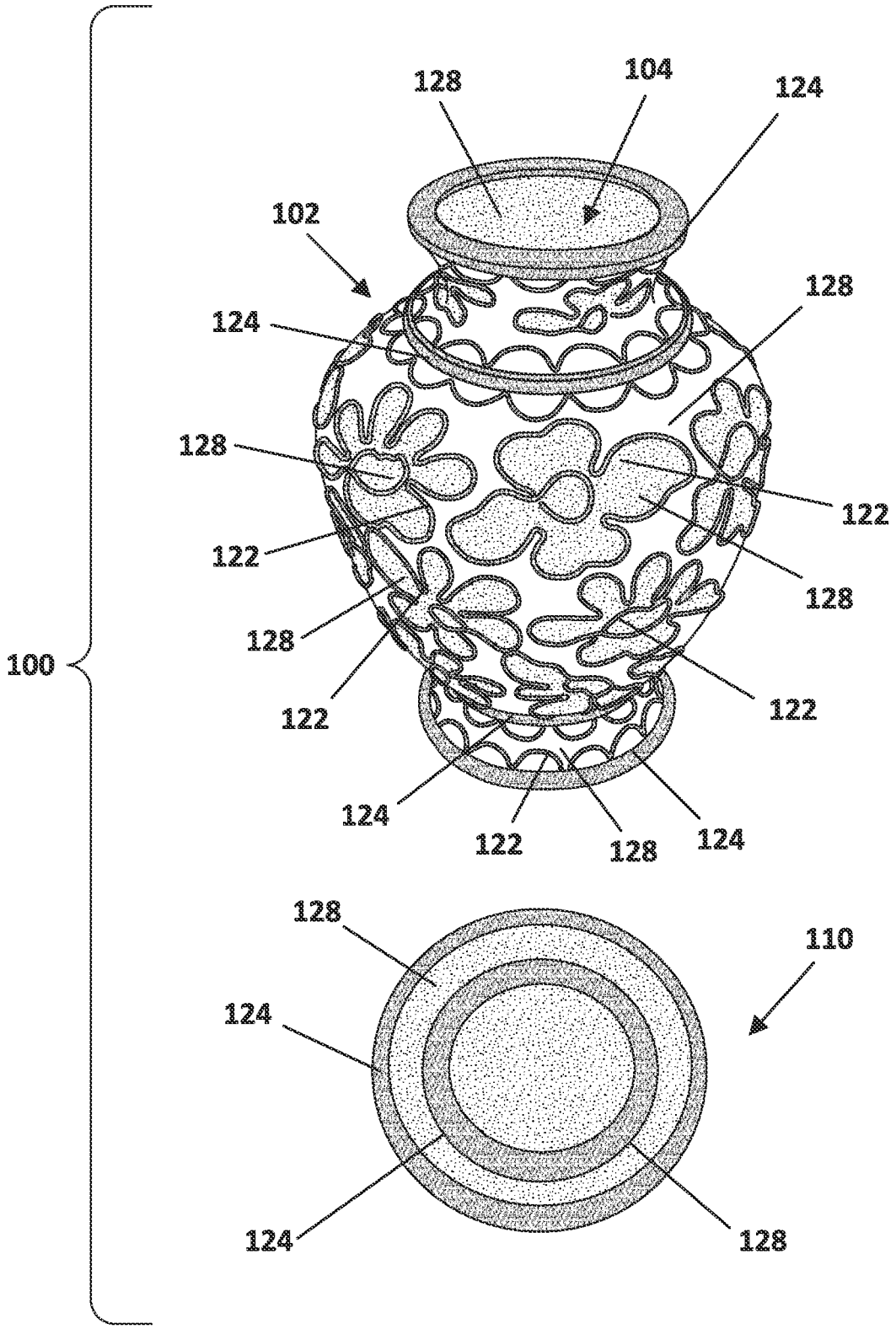
FIG. 12 is another isometric view of the urn after baking the layers of enamel into the cells formed by the pattern of filigree wires.

FIG. 10 illustrates step 206 in more detail including several sub-steps for filling the cells 130 with the enamel 128. FIGS. 11 and 12 show the urn 100 after completion of step 206. Referring now to FIGS. 10-12, step 206 can include sub-step 206*a* of applying a first layer of the enamel 128 to the cells 130 formed by the filigree wires 122. In some examples, the enamel 128 is initially in powdered form and water is then added so that the enamel 128 can be applied to the cells 130 using a dropper. The enamel 128 when applied using the dropper is a sandy mixture that sticks to the exterior surfaces of the container body 102 and lid 110. Various colors of enamel 128 can be applied to the cells 130 using the dropper to provide a colorful decorative pattern.

A significant advantage of the method 200 is that the enamel 128 grips better onto the filigree wires 122 due to the beaded surface of the filigree wires 122. This can help maintain the enamel 128 within the cells 130 formed by the decorative pattern of filigree wires 122 so that the enamel 128 does not unintendedly run across the exterior surface of the urn 100 and cross over into adjacent cells 130.

During sub-step 206*a*, a first layer of the enamel 128 can also be applied to the internal cavity 104 of the container body 102 and to the interior surfaces of the lid 110 using brushes, knives, spatulas, etc. The enamel 128 can be applied to the internal cavity 104 of the container body 102 and to the interior surfaces of the lid 110 without having to use the dropper which can speed up the process. During sub-step 206*a*, the enamel 128 is not applied to the filigree wires 122 or the transition surfaces 124.

Next, step 206 can include sub-step 206*b* of baking the container body 102 and lid 110, and the first layer of enamel 128 in a furnace. The temperature of the furnace is raised to about 850□ for about 2 minutes. The furnace can be an electric or coal furnace. In a preferred example, the furnace is an electric furnace for the reasons discussed above.

Thereafter, step 206 includes sub-step 206*c* of applying a second layer of the enamel 128 to the cells 130. The second layer of the enamel 128 can be applied to the cells 130 using the dropper. The second layer of the enamel 128 can follow the pattern of the first layer of the enamel 128, and can make the enamel 128 thicker and less transparent. Also, the second layer of the enamel 128 can fill empty areas where air bubbles have popped in the first layer of the enamel 128.

In some examples, sub-step 206*c* can also include applying a second layer of the enamel 128 to the internal cavity 104 of the container body 102 and to the interior surfaces of the lid 110 using the brushes, knives, spatulas, etc. During sub-step 206*c*, the enamel 128 is not applied to the filigree wires 122 or the transition surfaces 124.

Next, step 206 can include sub-step 206*d* of baking the second layer of the enamel 128 in a furnace. The temperature of the furnace is raised to about 850□ for about 2 minutes. The furnace can be an electric or coal furnace. In a preferred example, the furnace is an electric furnace for the reasons discussed above.

As shown in FIGS. 11 and 12, different colors and shades of the enamel 128 can be applied to the cells 130 formed by the decorative pattern of filigree wires 122. For example, a dark blue enamel can fill certain cells 130 and a light blue enamel can fill other cells 130 to create a colorful decorative flower pattern on the urn 100.

A significant advantage of the method 200 is that only two layers of the enamel 128 are applied to the urn 100. This is less than would be required during a traditional cloisonné technique that uses flat metal wires because the cloisonné technique requires many layers of enamel (i.e., more than two) to be baked into cells formed by the flat metal wires in order to fill the cells to the top edges of the flat metal wires. In contrast, the enamel 128 in the method 200 does not need to be filled to the top edges of the filigree wires 122 because the edges of the filigree wires 122 will protrude (e.g., stand out) from the exterior surface of the urn 100 when the method 200 is complete.

As shown in FIGS. 11 and 12, the width of the filigree wires 122 (e.g., the distance the filigree wires 122 stand out from the exterior surface of the urn 100) is greater than the combined thickness of the first and second layers of enamel 128, such that the filigree wires 122 are exposed around the exterior surfaces of the urn 100. Thus, the layers of the enamel 128 leave exposed portions of the filigree wires 122 that extend beyond exterior surfaces of the container body 102 and lid 110.

Figure 13:
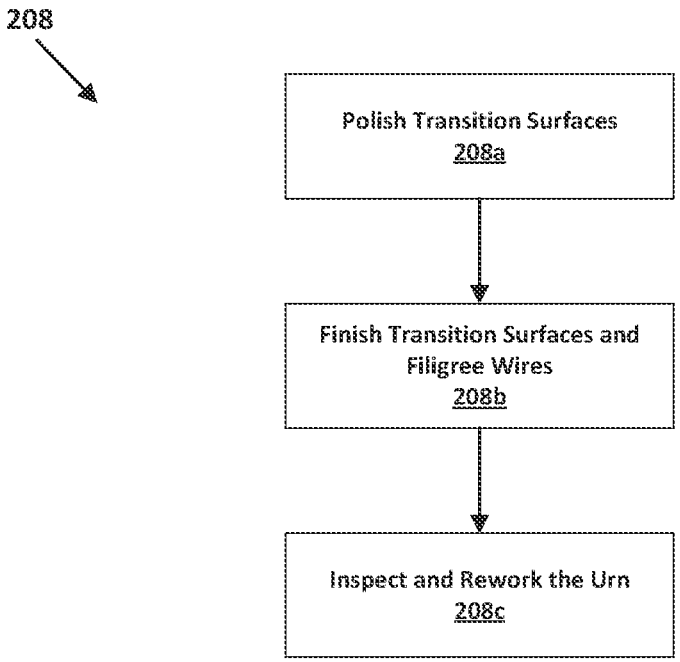
FIG. 13 illustrates another detailed portion of the method of FIG. 2.

FIG. 13 illustrates step 208 in more detail including several sub-steps for applying the finish to the filigree wires 122 and to the transition surfaces 124 on the container body 102 and lid 110. As shown in FIG. 13, step 208 can include a sub-step 208*a* of polishing the transition surfaces 124 on the container body 102 and lid 110 that have not been covered with the enamel 128. In some examples, the transition surfaces 124 are polished by spinning the urn 100 on a lathe and applying a polishing pad while the urn 100 spins on the lathe to polish the transition surfaces 124. In some examples, the polishing pad is a stone. Polish pads having different degrees of hardness can be used to polish the urn 100 as may be needed or desired.

Figure 14:
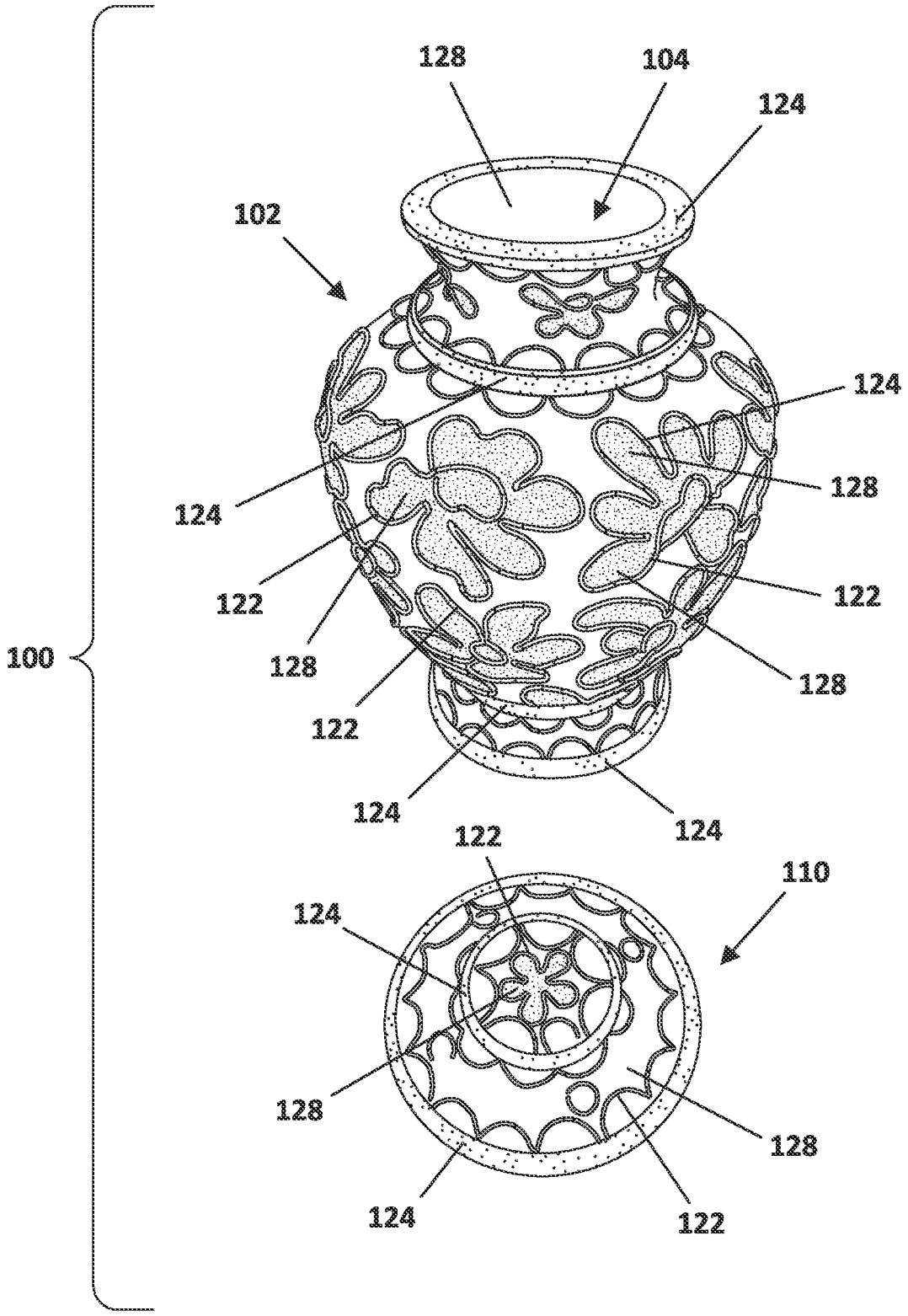
FIG. 14 is an isometric view of the urn after polishing transition surfaces of the container body and lid of the urn not covered by the enamel.
Figure 15:
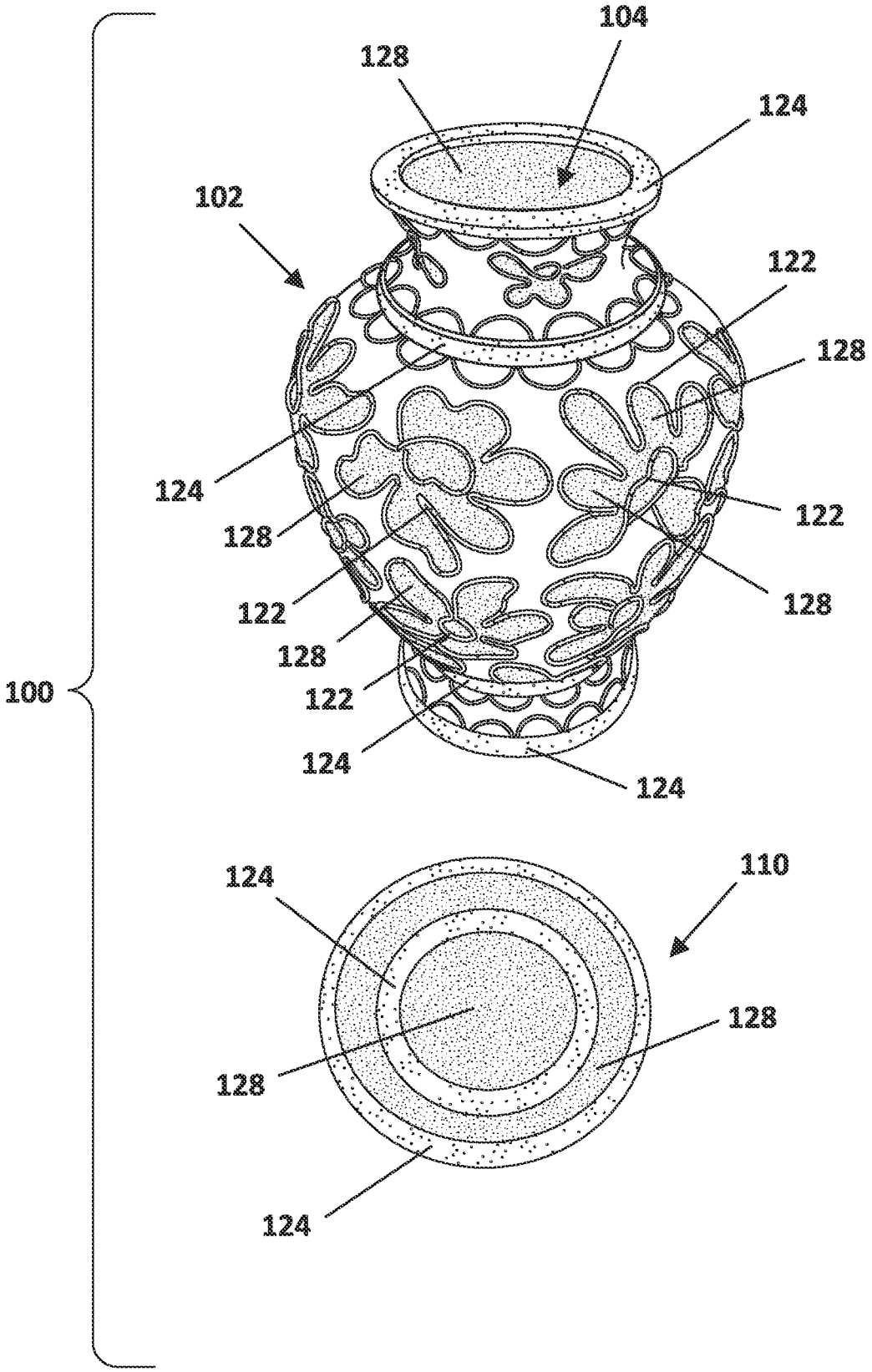
FIG. 15 is another isometric view of the urn after polishing the transition surfaces of the container body and lid of the urn not covered by the enamel.

FIGS. 14 and 15 show the urn 100 after sub-step 208*a* of polishing the transition surfaces 124. As shown in these figures, the transition surfaces 124 can be located above, between, and below the narrowed neck portion 120, the rounded middle portion 118, and the pedestal portion 116 of the container body 102. The transition surfaces 124 can also be located on the lid 110. Since the container body 102 and lid 110 are made from sheets of copper, the transition surfaces 124 are copper surfaces. After completion of sub-step 208*a*, the transition surfaces 124 have a clean and lustrous appearance.

A significant advantage of the method 200 is that the exposed edges of the filigree wires 122 do not need to be polished to be flush with the enamel 128 because the exposed edges of the filigree wires 122 have a smooth, beaded texture. Similarly, the enamel 128 also does not need to be polished because the enamel 128 is not filled at or past the filigree wires 122. Thus, less enamel 128 is used, and no polishing of the filigree wires 122 or the enamel 128 is required during the method 200.

In contrast, traditional cloisonné wires are flat wires that have sharp exposed edges that must be polished. Also, the enamel can be filled past the traditional cloisonné wires. Thus, the traditional cloisonné process requires that both the traditional cloisonné wires and the enamel be polished. Polishing the traditional cloisonné wires and the enamel so that they are flush with one another requires the use of additional machinery such as various grinding and polishing equipment, and can be very labor intensive. Thus, by using the filigree wires 122, the method 200 significantly reduces the machinery and labor needed to create a finished cloisonné product.

As shown in FIG. 13, step 208 can include a sub-step 208*b* of finishing the transition surfaces 124 and filigree wires 122. In some examples, the finishing in sub-step 208*b* includes electroplating the transition surfaces 124 and filigree wires 122 with a metal such as nickel, silver, gold etc. that generates a smooth, polished, and shiny finish. In addition to aesthetic qualities, finishing the transition surfaces 124 and filigree wires 122 with an electroplated metal can also improve the abrasion and wear resistance, and provide corrosion protection to the transition surfaces 124 and filigree wires 122.

In some examples, sub-step 208*b* is a standard electroplating process where the container body 102 or lid 110 (i.e., the parts to be plated) are the cathode of a circuit, and the metal to be plated onto these parts is the anode. Both the cathode and anode can be immersed in a solution containing ions that permit the flow of electricity. A power supply generates a direct current to the anode, oxidizing its metal atoms, and allowing them to dissolve in the solution. At the cathode, the ions in the solution are reduced at the interface between the solution and the cathode, such that they plate onto the cathode. During sub-step 208*b*, the cells covered by the layers of the enamel 128 are not plated.

Figure 17:
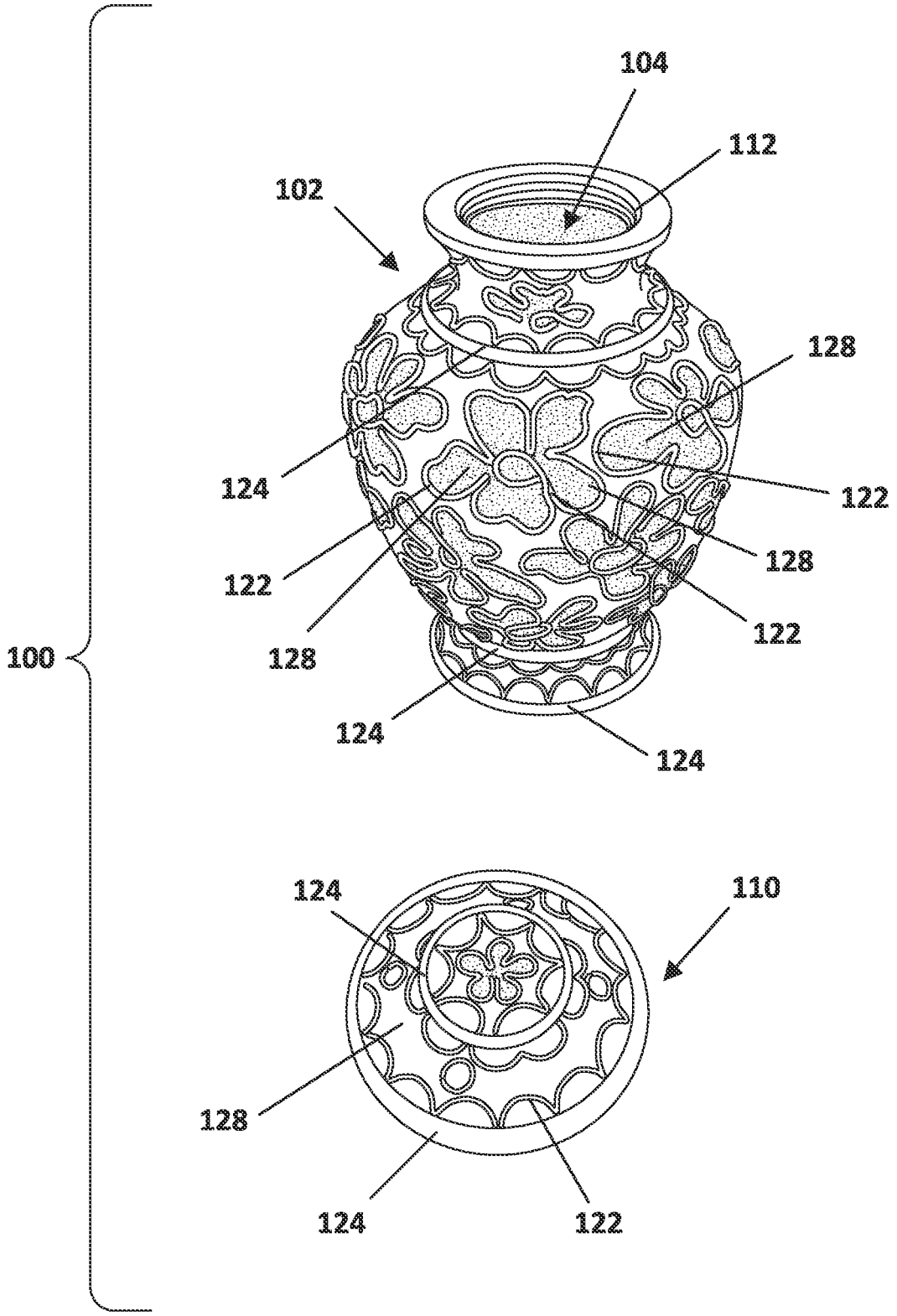
FIG. 17 is an isometric view of the urn after electroplating the filigree wires and transition surfaces, and installing a lid fastening assembly to the container body and lid.
Figure 18:
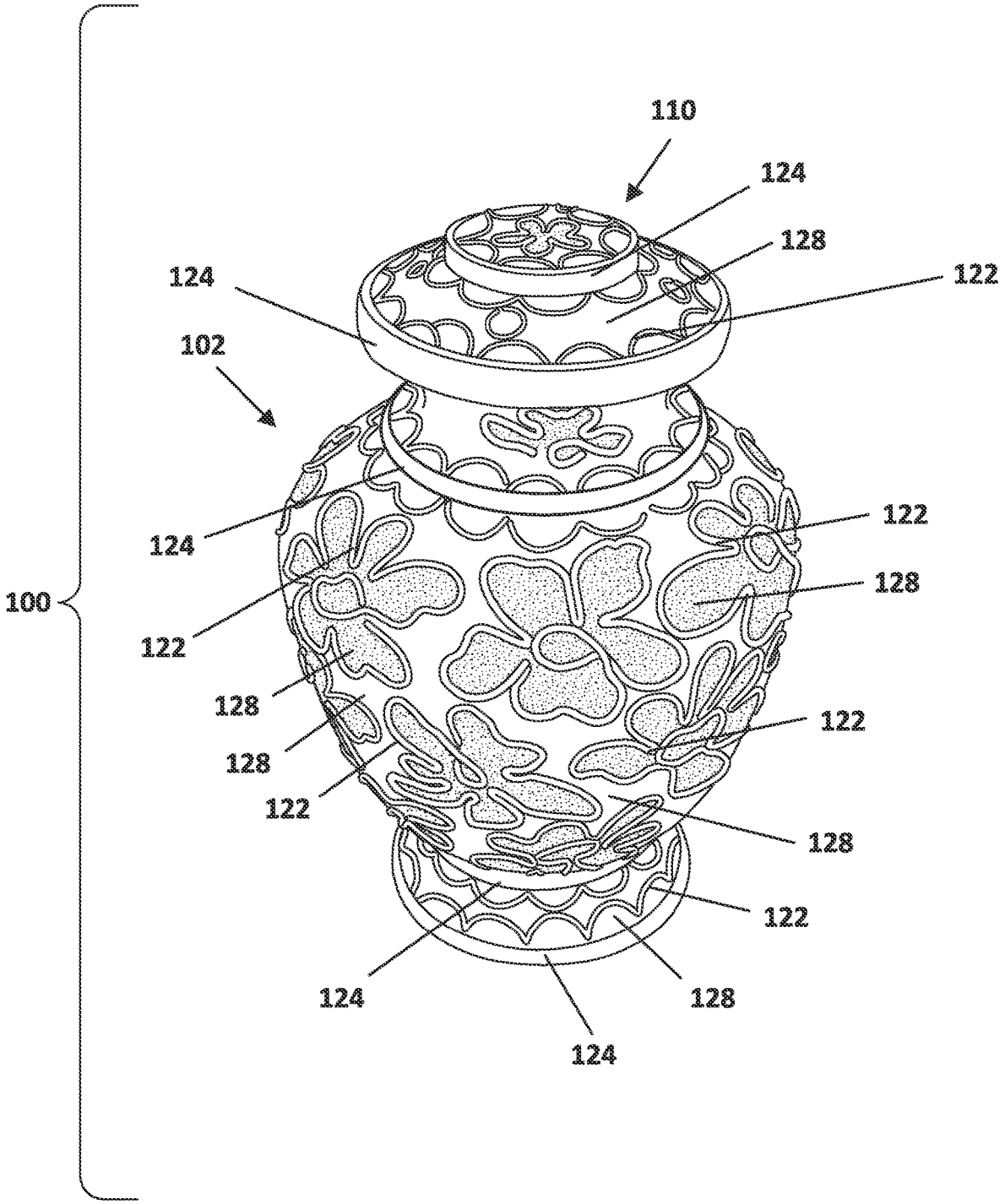
FIG. 18 is another isometric view of the urn after electroplating the filigree wires and transition surfaces, and installing the lid fastening assembly.

FIGS. 17 and 18 are isometric views of the urn 100 after completion of sub-step 208*b*. In the example shown in FIGS. 17 and 18, the transition surfaces 124 and filigree wires 122 are electroplated with nickel. As shown in FIGS. 17 and 18, the transition surfaces 124 and filigree wires 122 have a smooth, shiny, and polished appearance. As also shown, the cells baked with the layers of the enamel 128 are not electroplated such that the colored enamel 128 between the filigree wires 122 remains visible.

Referring back to FIG. 13, step 208 can include a further sub-step 208*c* of inspecting the urn 100, and reworking any of the previous steps of method 200 as may be needed to correct any deformities. For example, sub-step 208*c* can include inspecting the quality of the enamel 128 to identify the presence of any air bubbles. When air bubbles in the enamel 128 are detected, sub-step 208*c* can include applying additional enamel or a filler where needed to cover the air bubbles in the enamel 128.

Sub-step 208*c* can further include inspecting the cells 130 to identify areas where the enamel 128 may have unintentionally crossed from one cell 130 into another cell 130 in the decorative pattern defined by the filigree wires 122.

Additionally, sub-step 208*c* can include inspecting the exterior surfaces of the container body 102 and lid 110 to identify areas where the filigree wires 122 are loose. When one or more filigree wires 122 are identified as loose, sub-step 208*c* can include applying additional glue or solder where needed to securely attach the filigree wires 122 to the exterior surfaces of the container body 102 and lid 110.

Furthermore, sub-step 208*c* can include inspecting the exterior surface of the container body 102 and lid 110 to identify areas that are rough or unpolished. When it is detected that one or more areas are rough, sub-step 208*c* include additional wire cutting, trimming, and grinding as may be needed or desired to ensure that all of the surfaces of the urn 100 are smooth and polished.

Figure 16:
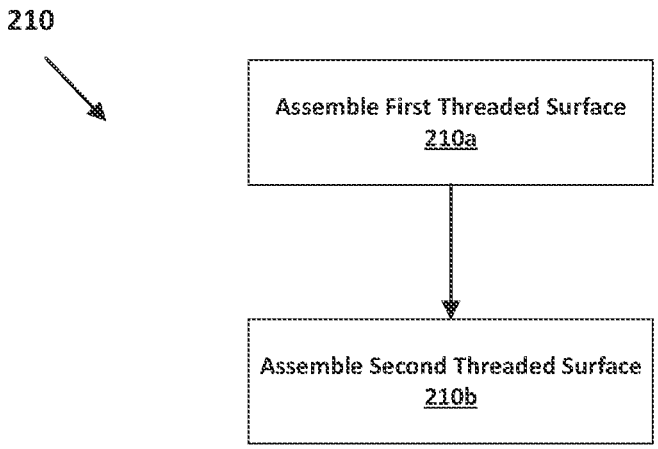
FIG. 16 illustrates another detailed portion of the method of FIG. 2.

FIG. 16 illustrates step 210 in more detail including several sub-steps for installing the lid fastening assembly 113 onto the urn 100. FIGS. 17 and 18 are isometric views of the urn 100 after installing the lid fastening assembly 113. Referring now to FIGS. 16-18, step 210 can include a sub-step 210*a* of assembling the first threaded surface 112 onto the container body 102. The first threaded surface 112 can be assembled onto the container body 102 using an adhesive. In some preferred examples, the adhesive is a glue that permanently attaches the first threaded surface 112 around the opening 121 of the container body 102. In other examples, the adhesive is solder that can permanently attach the first threaded surface 112 around the opening 121.

Thereafter, step 210 can include a sub-step 210*b* of assembling the corresponding second threaded surface 114 (see FIG. 1) onto the lid 110. The same type of adhesive used to attach the first threaded surface 112 can be used to permanently attach the corresponding second threaded surface 114 onto the lid 110.

Once the lid fastening assembly 113 is installed, the second threaded surface 114 can thread onto the first threaded surface 112 for sealing the internal cavity 104 of the urn 100. In certain examples, cremation remains can be stored inside the internal cavity 104, and the second threaded surface 114 can be threaded onto the first threaded surface 112 for sealing the internal cavity 104 with the cremation remains therein.

Upon completion of the method 200, it can be appreciated that the urn 100, as depicted in the drawings, is a decorative piece of high artistic value that can be produced using a modified cloisonné technique with significantly reduced labor and associated costs. As described herein, the method 200 provides many significant advantages over traditional techniques, including, but not limited to (1) using the filigree wires 122 that better grip the enamel 128 to the exterior surfaces of the urn 100; (2) only two layers of enamel are applied to the urn 100; and (3) the exposed edges of the filigree wires 122 do not need to be polished to be flush with the enamel 128.

Various modifications and alterations of this disclosure will become apparent to those skilled in the art without departing from the scope and spirit of this disclosure, and it should be understood that the scope of this disclosure is not to be unduly limited to the illustrative examples set forth herein.

What is claimed is:

1. A method of manufacturing a cremation urn comprising:

forming a container body and a lid for storing ashes;

attaching filigree wires to at least one of the container body and the lid, the attached filigree wires forming a plurality of cells on the at least one of the container body and the lid;

filling first and second layers of enamel into the plurality of cells, leaving the filigree wires extending beyond the first and second layers of enamel such that the layers of enamel leave exposed portions of the filigree wires which extend beyond exterior surfaces of the at least one of the container body and the lid; and applying a finish to the exposed portions of the filigree wires.

2. The method of claim 1, wherein attaching filigree wires to at least one of the container body and the lid includes:

using an adhesive to attach the filigree wires, sprinkling a powdered solder over the filigree wires, and baking the filigree wires and powdered solder in a furnace.

3. The method of claim 1, wherein forming the container body and the lid includes cutting flat metal sheets into appropriate sizes, and shaping the flat metal sheets.

4. The method of claim 1, further comprising installing a lid fastening assembly for connecting the lid to the container body.

5. The method of claim 4, wherein installing the lid fastening assembly includes:

assembling a first threaded surface around an opening of the container body; and assembling a second threaded surface onto the lid.

6. The method of claim 1, wherein applying the finish to the filigree wires includes electroplating the filigree wires with nickel.

7. The method of claim 1, further comprising using a dropper to apply the first and second layers of enamel into the plurality of cells.

8. The method of claim 1, further comprising applying first and second layers of enamel to an internal cavity of the container body and to an interior surface of the lid.

9. The method of claim 8, further comprising using a brush to apply the first and second layers of enamel to the internal cavity and to the interior surface of the lid.

10. The method of claim 1, wherein the filigree wires are not polished and are not flush with the first and second layers of enamel.

* * * * *